US005398726A

United States Patent [19]

Sussman

[11] Patent Number: 5,398,726

[45] Date of Patent: Mar. 21, 1995

[54] PRESSURE NOISE SUPPRESSION VALVE

[76] Inventor: Arthur Sussman, P.O. Box 113, Alpine, N.J. 07620

[21] Appl. No.: 28,560

[22] Filed: Mar. 5, 1993

[51] Int. Cl.[6] ..... F15B 21/00

[52] U.S. Cl. ..... 137/806; 137/807; 137/557

[58] Field of Search ..... 137/558, 559, 806, 807, 137/557

[56] References Cited

U.S. PATENT DOCUMENTS

| | | | |
|---|---|---|---|
| 3,358,507 | 12/1967 | Montgomery | 137/558 |
| 3,467,121 | 9/1969 | Bowles | 137/806 |
| 3,545,468 | 12/1970 | Freeman et al. | 137/806 |
| 3,721,255 | 3/1973 | Suzuki et al. | 137/807 |
| 4,150,561 | 4/1979 | Zupanick | 137/807 |
| 4,947,895 | 8/1990 | Lillicrap | 137/807 |

*Primary Examiner*—A. Michael Chambers
*Attorney, Agent, or Firm*—Ezra Sutton

[57] ABSTRACT

The invention provides a pressure noise suppression system which includes a fluid input circuit 22 for receiving pressure pulses carried by a first fluid which is displaceable; a fluid vessel 10 having a non-linear tube 28 containing a second fluid; a signal generator 18 for transmitting pressure pulses carried by the first fluid for displacing the second fluid; a fluid output circuit 36 having a displaceable third fluid; and a pressure sensor 38 for sensing pressure impulses which pass through the second fluid.

10 Claims, 3 Drawing Sheets

PRESSURE NOISE SUPPRESSION VALVE

FIELD OF INVENTION

This invention relates to signal filtering systems, more particularly to systems that use a first fluid as the signal transmitting medium, wherein the invention attaches to said system, and makes use of a second fluid of higher density, contained in a vessel that blocks unwanted signals, transmits wanted signals and easily attaches to said system.

DESCRIPTION OF THE PRIOR ART

Fluid control systems are well known, whereby a fluid such as a liquid, gas, or vapor is used as a signal transmitting medium, and pressure sensors and switches and relays are used as control components. Fluid control systems are used in applications where electrical controls may present a fire, or explosion hazard, or in a system where a fluid provides the work energy and whereby a fluid control systems would be more convenient, avoiding the need to convert to electricity to measure and control the work of said system. In a system that uses air as the transmitting medium, such system consists of an air generator that supplies an air signal carrier to other components within a control circuit, such as one of a multiple of air-activated valves, pressure sensors, switches, and work components such as motors. Should the action of a component in the circuit create an unwanted pulse or pulse wave, a malfunction of the circuit and machinery can occur.

Laundry washing machines use pressure type sensors to measure the level of water added to the machine during each fill cycle. Controls installed on such washing machines include a timer, or programmer, which control the timing of wash operations and electric relays which activate work components such as drain valves, and water valves in response to such activation. During a programmed fill cycle, relays activate the valves connected to the water lines that may include a hot water valve, a cold water valve or a mixture means adding a cold and hot water mixture to the machine. Single, or multiple pressure sensors or switches are attached to the machine typically in the control compartment of said machine which are connected to the bottom of the machine by way of an air tube which connects a compression fitting at the bottom of the machine, to a tube connecting means at each pressure switch, or sensor. When the timer or programmer signals corresponding water valves to add water to the machine, said connecting air tube and the pressure is proportional to the height of water in the machine. Certain machines use Diaphragm-type pressure sensors that expand in proportion to air pressure in the connecting air tube and in proportion to the height of water in the machine air tube.

Certain other machines use voltage porportion sensors to measure water height. With the former a switch that is attached to such sensor, activates when the diaphragm expands in contact with said switch position sensing element. The switch disposed to a normally closed position switches to an open position when the water level in the machine corresponding diaphragm expansion reaches a pre-set value. Such switch activation opens the relay that activates the water valves, thereby disconnecting electicity to the singular, or multiple activated water valves, and water stops flowing into said washing machine.

With most commercial-type washing machines, motor driven means rotate the drum in an alternating clockwise and counterclockwise direction during a fill cycle to wet the clothes in the shortest amount of time, as well as to maximize cleaning action brought about in such agitation. The agitation of these machines, and resulting turbulance of the water inside the machine produce pressure pulses within the air tube, that attaches to said water level sensors, and which are sensed by the water level pressure sensors and which interfere with the water level sensing pressure signal. When the pressure sensors respond to these unwanted pulses, erroneous signals are transmitted to the singular or multiple water valves which erroneously activate, resulting in inaccurate water levels, excessive water usage, excessive sewage costs, poor work quality, and lost production time. This describes one example of the effects of interfering pressure signals on a fluid control system.

Mechanical snubber devices are well known, and are used in fluid control circuits to remove unwanted pressure pulses. Such snubber devices use either an adjustable needle valve within a housing that attaches intermediate to signal transmitting means, and sensor means within a circuit. To suppress or dampen such circuit pressure noise, the needle valve after installation into the fluid line is adjusted to limit the amount of fluid that travels through the orifice of the needle valve. Such adjustment is made to allow a wanted signal of lower frequency to transmit along a fluid such as air in a circuit, axed to block pressure pulses of shorter duration, or preventing such unwanted pulses from reaching sensor with a circuit.

Needle valve type suppression systems are ineffective, particularly when a gas, vapor, or air is used within the fluid control circuit because of the compressibility of such fluids. Because of the relatively small size and volume of gas molecules relative to the total volume within a fluid control circuit, the flow of molecules through an orifice of the needle type valve is very large, and total noise suppression at higher frequencies is virtually impossible. Needle valves are also prone to failures from a total blockage in the line that can be caused by foreign matter that may get into the fluid line, or from corrosion caused by certain types of fluids, particularly with metal type valves, that are required to achieve small dimension machining tolerances.

Piston type snubbers are also known. Such snubber types use a mechanical spring and piston rings to limit fluid flow within a circuit whereby a piston, connecting springs, and slide rings are used to control fluid flow within a circuit. Piston-type snubbers are usually designed for high pressure type fluid system. The piston type snubber requires parts manufactured to very tight tolerances, wherein the piston, connecting springs, sealing rings, move reliably within a chamber to provide a required time response, accurately and reliably. To change the frequency, all mechanical parts must be changed, as simply adjusting a spring will totally alter the time response of the device. The piston type snubber requires excessive maintenance as the properties of the device are substantially altered with wear of the mechanical surfaces in sliding contact, and like the needle-type snubber, the mechanical parts required to achieve close mechanical tolerances, are susceptible to corrosion, and contamination.

SUMMARY OF THE INVENTION

An object of this invention is to provide a novel noise filtering system. It is another object of this invention to provide a noise filtering system that is absolutely reliable. It is another object of this invention to provide a filtering system that requires no mechanical moving parts. It is another object of the invention is to provide a noise filtering system that is non-electronic. It is a further object of this invention to provide a noise filtering system that can be readily varied.

Other and additional objects of this invention will become apparent from the considerations of this entire specification including the claims and drawings hereof.

In accord, and fulfilling these objects one aspect of this invention is a non-electronic filtering system which utilizes a first fluid to block unwanted frequencies, that could otherwise transmit along a second fluid in the fluid control system and prevent such frequencies from interfering with the operation of said fluid control system.

The system of this invention constitutes a marked improvement over mechanical means in that it eliminates the need for machined mechanical parts that wear out, and are difficult to vary or adjust. This invention is also a marked improvement over electronic means for suppressing noise, as this means requires electrical power that constitutes fire and explosion hazards in certain fluid control applications.

BRIEF DESCRIPTION OF DRAWINGS

Understanding of this invention will be facilitated by reference to drawings of FIG. 1, FIG. 2, FIG. 3, FIG. 4, FIG. 5 and FIG. 6. It is expressly understood, however, that the drawings are for illustrative purposes only and are not to be construed as defining the limits of the invention. In the figures, wherein corresponding numerals indicates corresponding parts.

The parts used in system of this invention include a fluid. Fluid container means preferably of a plastic tubing material, formed, but not limited to helical assembly, rigid inner element which provides holding means for said tubing container means, tubing ends assembled to opposite ends of the inner rigid tube providing anti-drip means, outer housing end pieces for each end of the invention, providing means to enclose the inner element within said outer housing, means attaching each end piece and the outer housing, sealing means within each end piece that provides air tight sealing means of the said fluid, within container means, and fluid flow path, fluid that may be a liquid, a gas, or vapor, within container means and fluid flow path attached to each end piece for attaching the system of the invention to a fluid control circuit.

According to the invention, known connector means provide airtight means for attaching the system of the invention to a fluid control circuit.

Figure 1:
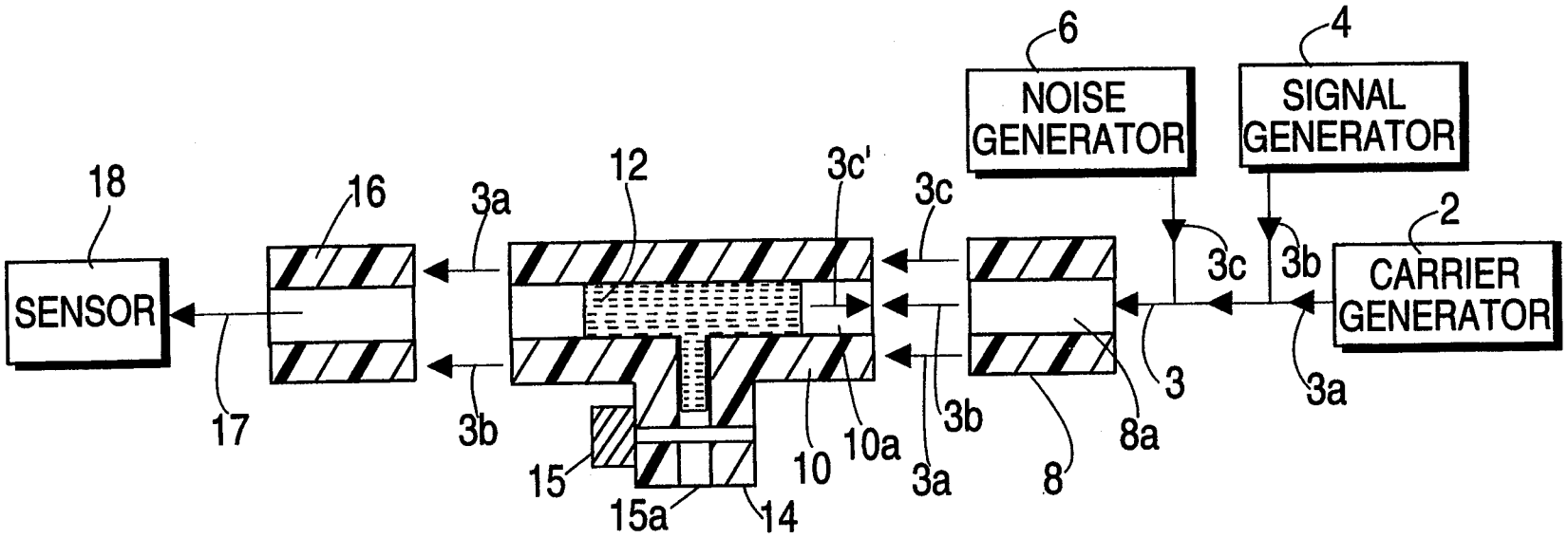
FIG. 1 is a schematic view of an embodiment of this invention and includes illustration of signal flow path.

With reference to FIG. 1, there is shown Carrier Generator 2, which imparts a pressure carrier wave 3*a* onto First Fluid Input Circuit 3. Signal generator 4 imparts pressure signal 3*b* onto 3 in response to mechanical action of such Signal Generator 4, that may be a valve, switch or relay, or oscillating device, imposing either a DC Pressure signal or Oscillating Pressure Signal onto 3. Noise Generator 6, in response to another portion of said fluid circuit imposes noise pressure wave 3*c* onto 3, 3*a*, and 3*b*. Each superimposed, travel to input connector 8, by way of transmitting fluid within first fluid input circuit 3, which may be a liquid, gas, or vapor. Input connector 8 provides airtight seal intermediate to first circuit component 3, and object fluid vessel 10.

Holes 8*a*, 10*a* and 16*a* disposed in alignment and connected to fluid input circuit 3, and fluid control output circuit 17, form a closed circuit with 3*a*, 3*b*, 3*c*, and sensor 18 constitute a complete fluid control circuit.

Object fluid 12 preferably a liquid is disposed within a section of hole 10*a* within object fluid vessel 10, Carrier 3*a*, Signal 3*b*, and Noise 3*c* transmit along input circuit 3, thereafter through Copnnector 8, and then impinges upon first surface of object fluid, preferrably a liquid. Said object fluid has a higher density than first transmittal fluid, preferrably air, and therefore responds to pressure impulses more slowly, than does the air. Other properties of the object fluid rendering it variable for time response include but are not limited to viscosity, coefficient of friction, mass, and volume.

The object fluid having a density higher than that of the air of the first transmitting fluid blocks certain pressure impulses such as Noise 3*c*, and transmits certain other pressure impulses, such as carrier 3*a*, and Signal 3*b*. Said noise 3*c*, having frequencies that are of less time duration than response time of object fluid are reflected from first object fluid surface. Carrier 3*a*, and Signal 3*b*, having time durations longer than response time of object fluid are transmitted through object fluid, and thereafter through output connector 16, through second fluid circuit 17, and finally to pressure sensor 18.

The object fluid fills the diameter of hole 10*a* fully and no first transmittion fluid can leak through the invention, as occurs with mechanical snubber means. Therefore, noise suppression is complete, and signal and carrier of fluid control system are absolutely improved. Also, object fluid will not wear down as it also serves as means for lubricating walls of hole 10*a* in object fluid vessel. Properties of the object fluid for varying time and frequency response of the invention include but are not limited to a. mass
b. viscosity
c. density
d. coefficient of friction The object fluid 12 is displaced within the vessel, as the pressure signal is sensed and transmitted through hole 10*a*. Time response, and amount of displacement depends upon the amplitude of the carrier 3*a*, and signal 3*b*, the mass, viscosity friction, and properties previously mentioned of the object fluid. When the signal 3*b* and barrier 3*a* are removed, the fluid is restored to its initial position. When a fluid such as a liquid of lower density is used, the time response will be faster. Pressure signals of higher frequency will be transmitted through the invention. Port 14 includes valve means 15, and a hole 15*a* for adding or subtracting object fluid of the invention with the use of an exernal reservoir of fluid, preferrably a liquid. Such addition or subtraction of object fluid enables varying response time of invention without the need to disconnect the system of the invention from fluid control circuit. The object fluid vessel preferrably is a tubular material wound in a helical coil form to accommodate larger object fluid displacments, without the need for making the vessel unacceptably long.

An air tight seal, as described in the preferred embodiment of the invention uses two separate end pieces each, containing a compression fitting that attaches the invention to first Input Circuit and to second Output Circuit. A ferrule inserted in each end of a cut end of the tubular material and compressed into each of the two end pieces forms an air tight seal between the tubular material and the two end pieces. Making use of Port 10, fluid can be added to or removed from the vessel to vary the amount of fluid in the vessel to vary the time response, and the frequency response of the invention or the fluid can be removed entirely and replaced by an entirely different fluid to change viscosity, and friction properties and likewise the resultant time response frequency of the invention. In the preferred embodiment of the invention, the object fluid carrier is transparent allowing the object to be viewed and inspected during fill procedures, and while the system of the invention is operating. In the preferred embodiment of the invention, the inner cylinder has a light reflective surface. The outer housing has one or a number of small inspection holes. To inspect fluid displacment in the object fluid vessel, light is directed through one or more holes in the outer housing, which thereafter transmits through the walls of fluid vessel, thereafter reflects from the surface of the inner cyliner, reflects back through the vessel, and exists through one or more holes in the outer housing.

It will be noted that use of a liquid as a noise suppression means, as described offers a unique solution to problems encountered with unwanted noise in fluid type control systems. With laundry washing machines, pressure, noise frequencies encountered are in the 10 cycles per second to the 0.2 cycle per second range. Signal amplitudes are in the 0–1.0 PSI range corresponding to 0–27.4 inches of water height. The filter fluid contained in the helical formed tubular material approximately 72" length occupies 6–8" length of the tube to suppress the noise pulses described above, which when installed suppresses 90% of the amplitude of the noise pulses, resulting in reducing water level setpoint errors from 4–6" to under 0.5" of water.

Figure 2:
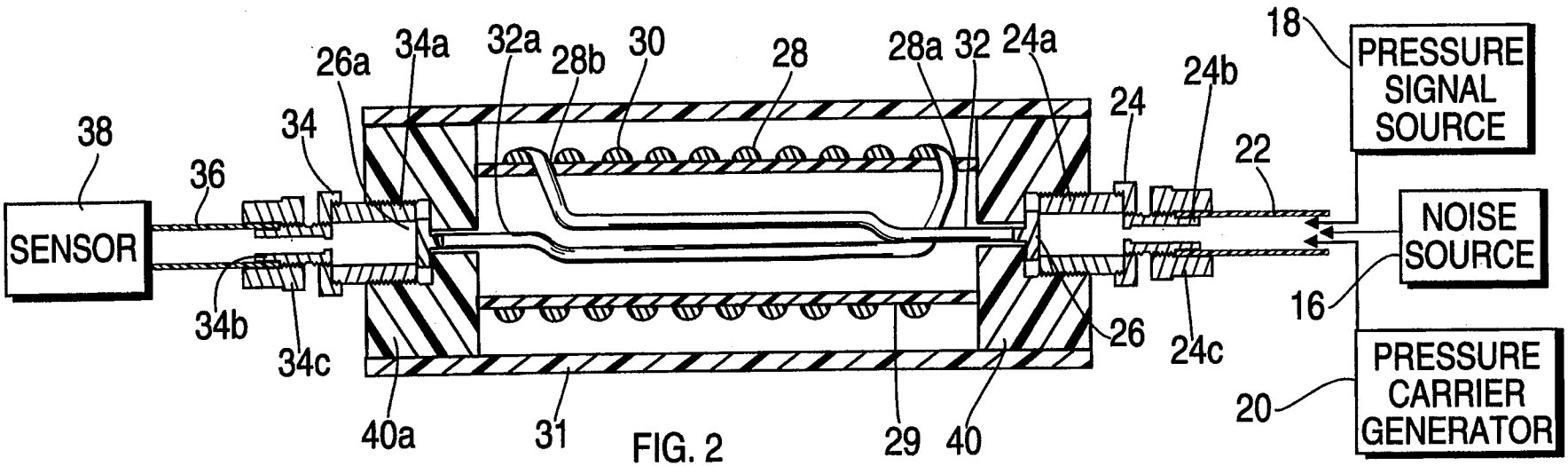
FIG. 2 is a diagrammatic representation of a preferred embodiment of the invention.

With the foregoing in mind, a preferred embodiment of the invention will be described with reference to FIG. 2. The Figure shows fluid circuit input 22 and fluid circuit output 36. Also shown are connector assemblies 24 and 34, end pieces 40 and 40*a* disposed into housing 31, object fluid vessel 28, disposed preferably in helical form around inner cylinder 29, containing holes 28*a*, and 28*b* to assemble object fluid vessel 28 to the inside of inner cylinder 29, pressure wave generators 16, 18, 20 respectively, and illustration of signals from said generators being imposed into first circuit 22, and sensor 28, assembled at the output second output circuit, 36.

Figure 3:
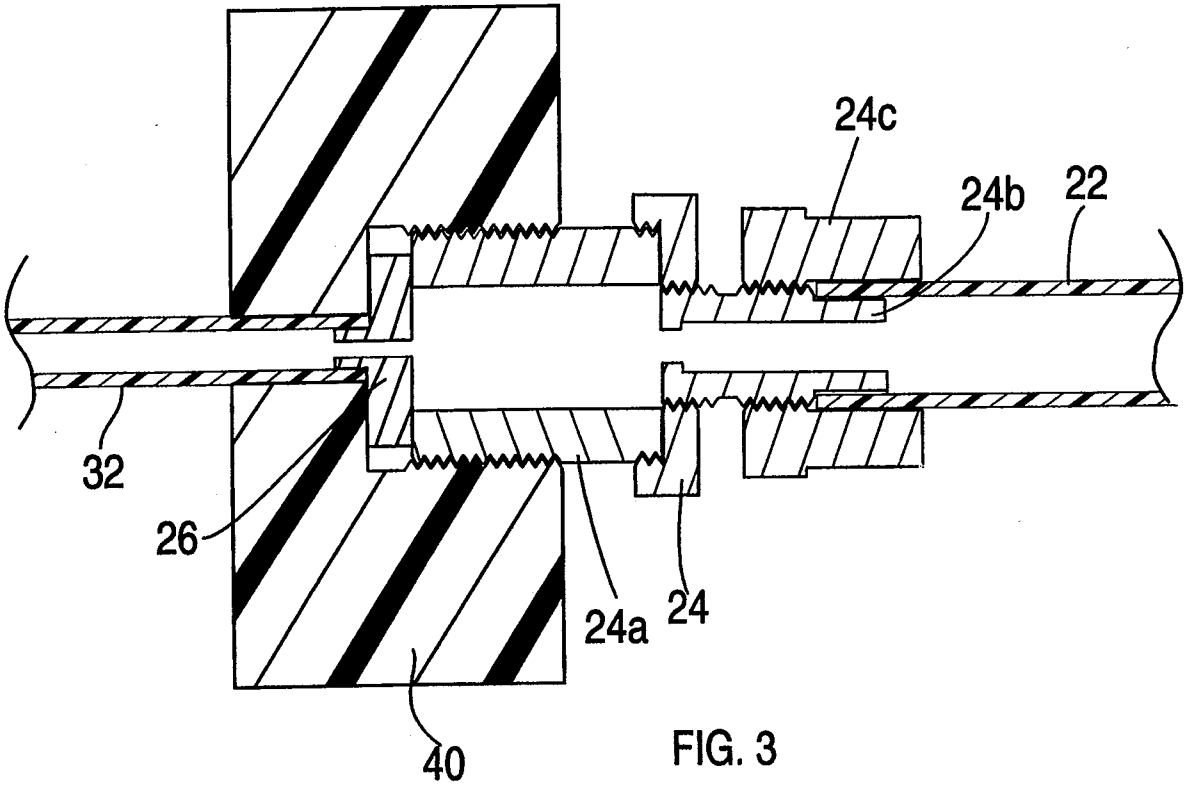
FIG. 3 illustrates cross-sectional view of connector means of invention.

Referring to FIG. 3, first input cirucit 22 preferrably of tubular construction is inserted into connector 24 containing threaded portion 24*a*, stem 24*b* and nut 24*c* all which contain concentric holes through their centers. When assembled nut 24*c* has an internal thread that matches the external thread of a portion of stem 24*b*. When 24*c* is disposed onto stem 24*b*, pressure between a portion of the inside wall of nut 24, first input circuit 22, outer surface of stem 24*b* forms an airtight seal of the invention to first input circuit 22.

Figure 5:
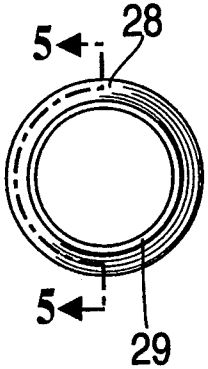
FIG. 5 is a cross-sectional view of helical form of object fluid vessel.
Figure 4:
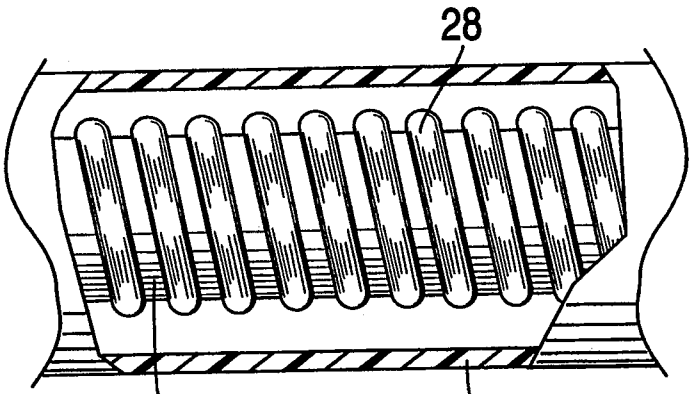
FIG. 4 illustrates portion of preferred embodiment of invention showing helical form of object fluid vessel.

Referring again to FIG. 2, likewise an airtight seal is made between second output circuit 36, and connector 34, containing threaded portion of 34*a*, stem portion 34*b*, and nut portion 34*c*. Object fluid vessel 28 is wound in helical form around inner cylinder 29 as shown in FIGS. 4 and 5. FIG. 5 shows a cross-section view of helical vessel 28 wound about inner cylinder 29. Referring again to FIG. 2, tubular ends 32 and 32*a*, are assembled to opposite ends of hollow portion of inner cylinder 29 by means of holes 28*a*, and 28*b*. Through the surface of inner cylinder 29, thereby preventing object fluid 30 placed in object fluid vessel 28 from leaking from said vessel when disposed in vertical position. Outer housing 31, and end pieces 40 and 40*a* enclose object vessel 28.

Referring to FIG. 3, an airtight seal is made between first and second ends of said vessel 28 and end pieces 40 and 40*a* respectively. As shown, first vessel end 32 is located in the hole of end piece 40. Ferrule 26 having a flange and a hole through its center, is inserted into vessel end 32. The female pipe thread in end piece 40 matches the male thread portion of connector 24. When the threaded portion of the connector 24*a* is disposed into end piece 40, it impinges pressure on the flange of ferrule 26 which thereafter compresses object vessel tubular end 32 against the hole surface of end piece 40 producing the required airtight seal. Referring again to FIG. 2, likewise second vessel tubular end is placed in hole of second end piece 40*a*. Ferrule 26*a* having a flange and hole through its center is inserted in second vessel tubular end 32*a*. When thread portion 34*a* is disposed into second end piece, second connector 34 impinges pressure on flange of ferule 26*a* which compresses second tubular end against hole surface, thereby producing air tight seal.

Figure 6:
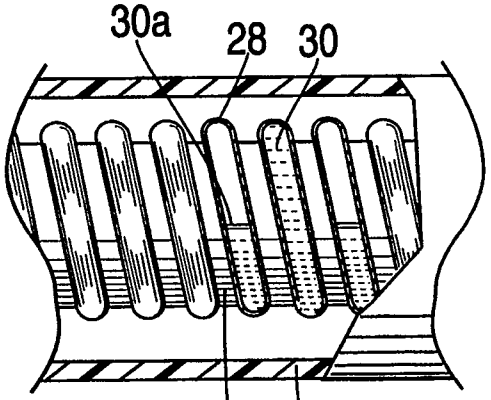
FIG. 6 shows object fluid disposed within object fluid vessel of the invention.

Referring to FIG. 6, an amount of object fluid 30 preferrably a liquid, is placed within the object fluid vessel, preferrably tubular and placed proximate to input side of invention to maximize displacement path for fluid (30). Referring again to FIG. 2, generators 16, 18, 20, impress pressure impulses in the form of carrier, signal, and noise onto fluid input circuit 22. Pressure waves from 16, 18, and 20 all superimposed, transmit through fluid circuit input 22, and thereafter through connector 24, end piece 40, and into object fluid vessel 28, and to first surface 31*a* of object fluid 30 as shown in FIG. 6. Certain properties of the object fluid including but not limited to the mass, viscosity, and friction of the object fluid determine the time for said pressure impulses to transmit through the object fluid 30, and thereafter on to the remainder of the circuit. Such properties of object fluid 30 are varied so that wanted signals from carrier 20 and signal source 18 are allowed to transmit through object fluid 30, and into sensor 38, and unwanted signals from noise source 16 are blocked at first surface of object fluid 30*a* as shown in FIG. 6 and prevented fron transmission to sensor 38. With signals of duration greater than the time response of said object fluid, the signal will not be transmitted. But unwanted signals impressed upon by first circuit 22 that are less than the object fluid time response will be reflected back, thus constituting a low frequency pass filter.

Since air is a compressible fluid, pressure signals will cause the object fluid to displace within the tubular material. Such displacement is in proportion to the amplitude of pressure signals. Use of the inner cylinder provides a form for accurately measuring the length of the tubular material, installed into said invention and holding it securely in place. The helical form of the tubular material allows said invention to process pressure signals of high amplitude, and resultant object fluid displacement, without objectionally extending the length of the invention. The signal that transmits along object fluid, thereafter transmits through end piece 40*a*, then through output connector 34, through second fluid circuit 36 and finally to pressure sensor 38.

The fluid circuit is necessarily a closed circuit, wherein the absence of the pressure signal the object fluid is restored to its undisplaced position within the tubular material. Pressure sensor means 38 senses the pressure signals impinging on its surface, and by way of a switching action, or other such action communicates such information for use as required by the fluid circuit. While two embodiments of the invention have been shown and described in detail, it is expressly understood that the invention is not limited thereto. Various changes may also be made in the design and arrangement of the parts without departing from the spirit and scope of the invention as the same will now be understood by those skilled in the art.

What is claimed is:

1. A pressure noise suppression system, comprising:

a) fluid input means for receiving pressure impulses carried by a first fluid which is displaceable;

b) fluid container means connected to said fluid input means, said fluid container means including a non-linear tube;

c) a non-compressible and displaceable second fluid in said non-linear tube;

d) means for transmitting said pressure impulses carried by said first fluid through said second fluid and for displacing said second fluid in said non-linear tube, said second fluid blocking the transmission of noise-type pressure impulses having a time period different from the time period of said second fluid;

e) fluid output means connected to said fluid container means having a third fluid therein which is displaceable;

f) pressure sensor means connected to said fluid output means for sensing said pressure impulses which pass through said second fluid; and g) means for sealing said fluid container means.

2. A system as described in claim 1 wherein the fluid is a liquid.

3. A system as decribed in claim 1, wherein the fluid container means is transparent to light.

4. A system as described in claim 1, further including connector means for adding fluid and removing fluid in said non-linear tube for changing the time response of said second fluid.

5. A pressure noise suppression system in accordance with claim 1, wherein said fluid container means includes an inner support member and said non-linear tube is a helical tube wound around said inner support member.

6. A system as described in claim 5, wherein the outer surface of said support member is light reflective for the purpose of testing displacement of said second fluid in said non-linear tube with the use of an inspection light directed through one or a multiple of holes in said support member, which thereafter transmits light through transparent segments of said non-linear tube and thereafter reflects said light from the surface of said support member, back again through said non-linear tube and through said inspection hole or holes in said support member, wherein the difference in light reflected indicates the presence or absence of said second fluid in said non-linear tube, thereby testing for fluid displacement.

7. A system as described in claim 5, further including a first input end piece and a second output end piece, each including a hole through its center, a first end of said non-linear tube installed in said hole through said center, a flanged ferrule having a hole therethrough and inserted into said non-linear tube end, which is press-fit into said first and second end pieces, thereby producing an airtight seal of said ferrule.

8. A pressure noise suppression system in accordance with claim 7, wherein said inner support member includes an interior chamber for containing sections of said non-linear tube.

9. A pressure noise suppression system in accordance with claim 5, wherein said inner support member includes first and second end members at opposite ends of said support member for receiving the first and second ends, respectively, of said non-linear tube, thereby forming anti-drip means.

10. A pressure noise suppression system in accordance with claim 5, wherein said inner support member includes first and second ends, a first section of said non-linear tube extending through said inner support member from said first end to said second end, a second section of aid non-linear tube extending in a helix around said support member from said second end to said first end, a third section of said non-linear tube extending through said inner support member from said first end to said second end of said inner support member.

* * * * *